US007549572B1

(12) United States Patent
Branan et al.

(10) Patent No.: US 7,549,572 B1
(45) Date of Patent: Jun. 23, 2009

(54) SECURE MAIL BOX

(76) Inventors: Scott C. Branan, 5325 Smithfield Ct., Sachse, TX (US) 75048; Charles L. Branan, 6934 Robin Willow, Dallas, TX (US) 75248

( * ) Notice: Subject to any disclaimer, the term of this patent is extended or adjusted under 35 U.S.C. 154(b) by 0 days.

(21) Appl. No.: 12/011,324

(22) Filed: Jan. 25, 2008

Related U.S. Application Data

(60) Provisional application No. 60/897,804, filed on Jan. 26, 2007.

(51) Int. Cl.
*B65G 11/04* (2006.01)

(52) U.S. Cl. ..... 232/45; 232/47; 232/52

(58) Field of Classification Search ..... 232/47, 232/45, 52, 17
See application file for complete search history.

(56) References Cited

U.S. PATENT DOCUMENTS 3,519,198 A * 7/1970 Benoliel ..... 232/17
5,526,979 A 6/1996 Mann
5,979,751 A 11/1999 Maddox
5,992,736 A 11/1999 Parker
6,244,505 B1 6/2001 Grimes et al.
6,299,061 B1 * 10/2001 Henson ..... 232/47
6,644,542 B2 11/2003 Cox et al.
6,655,577 B2 12/2003 Mihaylov et al.
6,976,620 B2 12/2005 Swider
7,040,529 B2 5/2006 Swider et al.

* cited by examiner

*Primary Examiner*—William L. Miller
(74) *Attorney, Agent, or Firm*—Roger N. Chauza, PC

(57) ABSTRACT

A mail box having a depository vault overlying a secure compartment. A main door and a flag door are independently rotatable to open and close an opening in the depository vault. The main door is attached to a mail platform for receiving mail in the depository vault. If the mail placed on the mail platform is incoming mail, the main door is rotated by the postman to the closed position to rotate the platform and deliver the incoming mail to the underlying secure compartment. If the mail placed on the platform is outgoing mail, the flag door is rotated by the user of the mail box to the closed position to provide an indication to the postman that the mail is to be picked up and delivered to the destination.

18 Claims, 8 Drawing Sheets

SECURE MAIL BOX

RELATED APPLICATION

This U.S. non-provisional patent application claims the benefit of pending U.S. provisional patent application filed Jan. 26, 2007, and accorded Ser. No. 60/897,804.

TECHNICAL FIELD OF THE INVENTION

The present invention relates in general to mail boxes, and more particularly to mail boxes of the type having a secure mail receiving compartment.

BACKGROUND OF THE INVENTION

Mail boxes serve the primary purpose of providing temporary storage for mail between a sender and a recipient. Some mail boxes are needed only to receive mail until retrieved by the recipient. This is the case with mail boxes provided by the U.S. Postal Service at a central mail center, and other private mail box service providers. In these situations, outgoing mail is deposited by the sender at other mail repositories, such as separate outgoing mail slots of the central mail station, or free standing inside or outside U.S. mail boxes. Other mail boxes serve both as repositories for incoming and outgoing mail. Traditional residential mail boxes and rural mail boxes are of this type. The person assigned to the mail box simply places outgoing main in the mail box, places the flag in the up position, whereupon the mailman picks up the mail before depositing incoming mail in the same mail box. Conventional mail boxes of this type have a hinged lid to open and close the mail box and maintain the incoming and the outgoing mail free from the elements, such as rain, wind, snow, etc.

While the foregoing mail boxes serve their functions, they are not without various disadvantages. A primary concern with mail boxes these days is the security of the mail so that an unauthorized person does not gain access to the mail deposited in the mail box. With the increasing incidents of identity theft, and when mail often includes important information such as social security-numbers, bank account numbers, passwords, etc., it is of paramount importance that mail passing through the U.S. Postal Service is maintained as secure as possible so that such private information remains confidential and not available to unauthorized parties.

Various mail boxes have been devised to improve the security of the mail deposited therein. Secure mail boxes are disclosed in U.S. Pat. Nos. 5,526,979 by Mann; 5,979,751 by Maddox; 5,992,736 by Parker; 6,244,505 by Grimes et al.; 6,655,577 by Mihaylov et al; 6,644,542 by Cox et al; 6,976,620 by Swider and 7,040,529 by Swider et al. However, these mail boxes involve numerous disadvantages and shortcomings.

Many of these prior art mail boxes employ either a hinged door or sliding tray that is movable outwardly away from the mail box in order to retrieve or deposit mail therein. The movement of the hinged door or sliding tray toward the person or mailman, makes the deposit of mail inconvenient. In other words, the person must stand some distance away from the mail box in order to allow the door or tray to be fully deployed outwardly. This is especially inconvenient in areas where the mail is delivered by a mailman using a vehicle. In this situation, the mailman must be careful not to drive the vehicle too close to the mail box, otherwise the door or tray of the mail box would strike the vehicle when opened fully.

Another disadvantage of the prior art mail boxes is that when equipped with hinged doors, the movement of the door to place outgoing mail on the bed moves the mail bed. In other words, when the person desires to mail a letter, the mail bed moves or rotates in unison with the opening or closing of the door to the mail box. This arrangement requires other complicated equipment and mechanisms to be employed so that when the postman picks up the outgoing mail, the opening of the door to the mail box does not inadvertently deposit the outgoing mail in the secure compartment underlying the rotatable mail bed.

From the foregoing, it can be seen that a need exists for an improved mail box that overcomes the problems and shortcomings of the prior art mail boxes. A need exists for a mail box in which access to the internal portion thereof for depositing either incoming or outgoing mail involves the movement of one or more doors sideways, rather than outwardly toward the person. Yet another need exists for a mail box having a door arrangement in which the mail bed does not move or rotate when the door is opened to deposit incoming or outgoing mail thereon.

SUMMARY OF THE INVENTION

In accordance with the principles and concepts of the invention, disclosed is a mail box with depository vault providing access thereto by one or more doors which pivot or rotate sideways, rather than outwardly. Also disclosed is an improved mail box equipped with a main door and a flag door, where the flag door does not rotate the platform on which mail is deposited.

The mail box according to one embodiment of the invention includes an engagement between the main door and the flag door so that both doors are rotated to an open position to place outgoing mail on the platform. Then, the flag door is rotated to the closed position to close the mailbox, without rotating the platform on which the outgoing mail rests. The flag door preferably includes an indication, such as a red color, to provide a visual indication to the postman that outgoing mail is in the mail box.

According to another feature of the invention, the main door and the flag door are engaged so that when the main door is rotated to the open position, the flag door is carried with it. The same is the case when the main door is rotated to the closed position. When a postman desires to leave incoming mail in the mail box of the invention, the main door is opened, which also carries with it the flag door. The postman deposits the incoming mail on the platform and closes the main door. The platform is moved in unison with the main door, and thus as the main door is rotated to the closed position by the postman, the platform rotates and drops the incoming mail into an underlying secure compartment. The secure compartment is structured so that mail dropped therein cannot be retrieved via the main door. Mail can only be retrieved via a lockable door on the secure compartment.

In accordance with one embodiment of the invention, disclosed is a mail box equipped with a depository vault having an opening thereto for depositing and receiving mail therein. The mail box includes a secure incoming compartment underlying the depository vault. A main door is rotatable to open and close the opening in the depository vault, and a flag door is rotatable to open and close the opening in the depository vault. A platform is mounted to the main door and rotated in unison with the main door. The platform is adapted for receiving incoming mail thereon via the opening in the depository vault, and when the main door is rotated to the closed position, the platform correspondingly rotates so as to drop the incoming mail in the secure incoming compartment.

In accordance with another embodiment of the invention, disclosed is a mail box having a barrel-shaped depository vault with opposing ends, where one end of the barrel-shaped depository vault is closed with a planar side, and an opposite end of the barrel-shaped depository vault has a semicircular-shaped opening therein for depositing and receiving mail in the depository vault. The mail box further includes a secure incoming compartment underlying the depository vault. A semicircular-shaped main door is rotatable to open and close the semicircular-shaped opening in said depository vault. A platform is mounted to the main door and is rotated in unison with the main door. The platform is adapted for receiving incoming mail thereon via the opening in the depository vault, and when the main door is rotated to the closed position, the platform correspondingly rotates so as to drop the incoming mail in the secure incoming compartment.

In accordance with one embodiment of the invention, disclosed is a method of using a mail box. The method includes rotating a main door of the mail box to an open position to expose an opening in the mail box, thereby allowing mail to be deposited in a depository vault of the mail box. Outgoing mail is deposited onto a platform located in the depository vault and a flag door is rotated to a closed position to close the opening in the mail box. The main door is left in the open position. The flag door is rotated by a postman to the open position to retrieve the outgoing mail deposited on the platform, and incoming mail is deposited by the postman on the platform and the main door is rotated to a closed position. The rotation of the main door causes rotation of the platform to thereby drop the incoming mail in a secure compartment located below said depository vault.

BRIEF DESCRIPTION OF THE INVENTION

Further features and advantages will become apparent from the following and more particular description of the preferred and other embodiments of the invention, as illustrated in the accompanying drawings in which like reference characters generally refer to the same parts, functions, elements throughout the views, and in which.

Figure 5A:
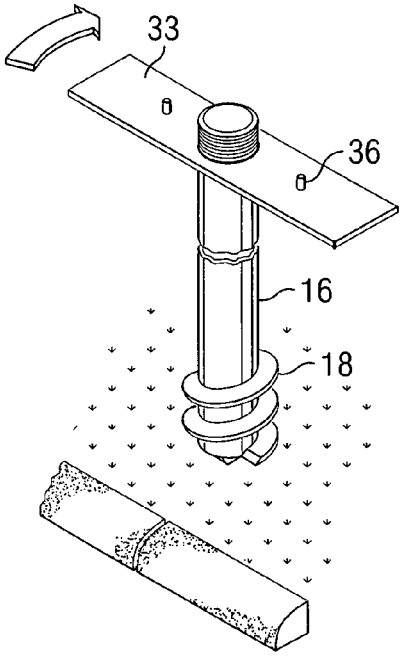
Figure 5C:
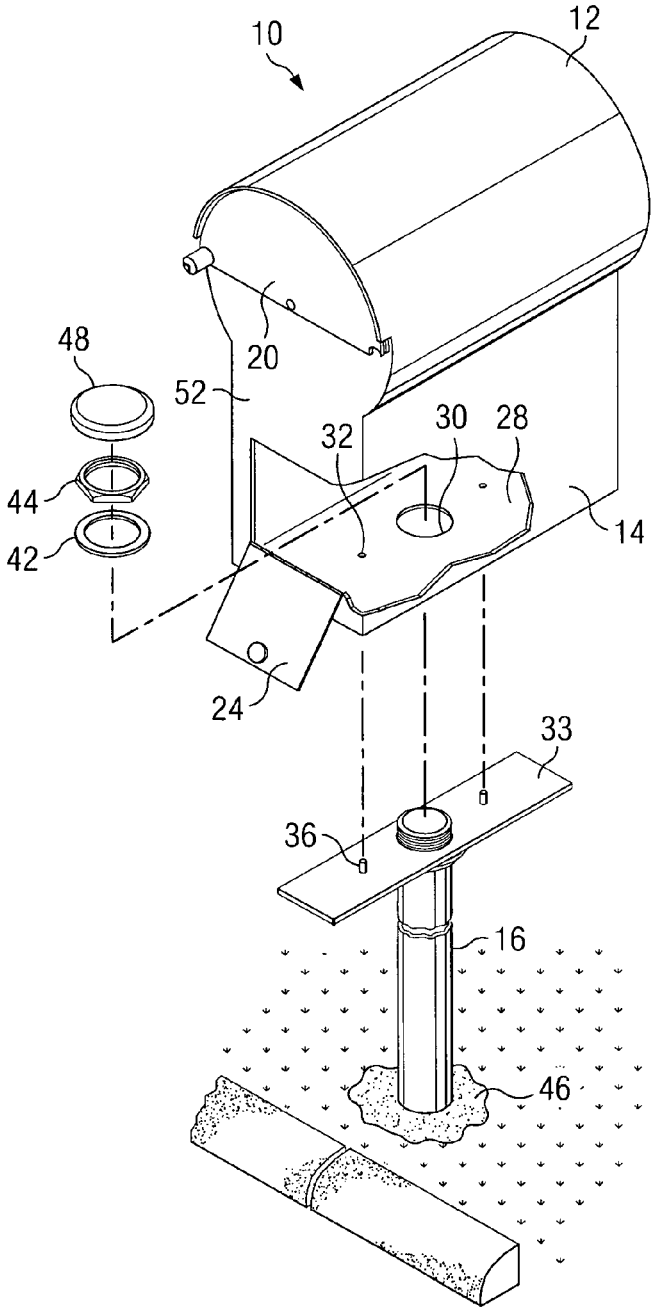
Figure 5B:
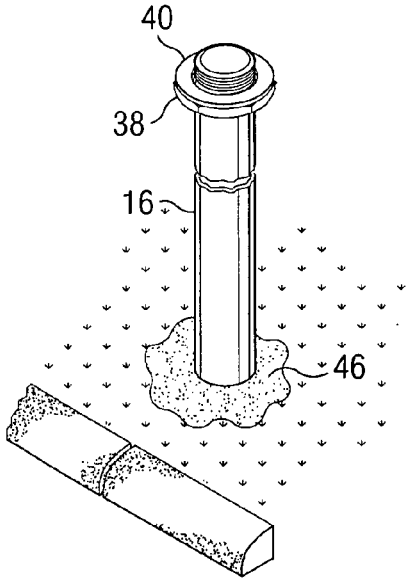
Figure 6B:
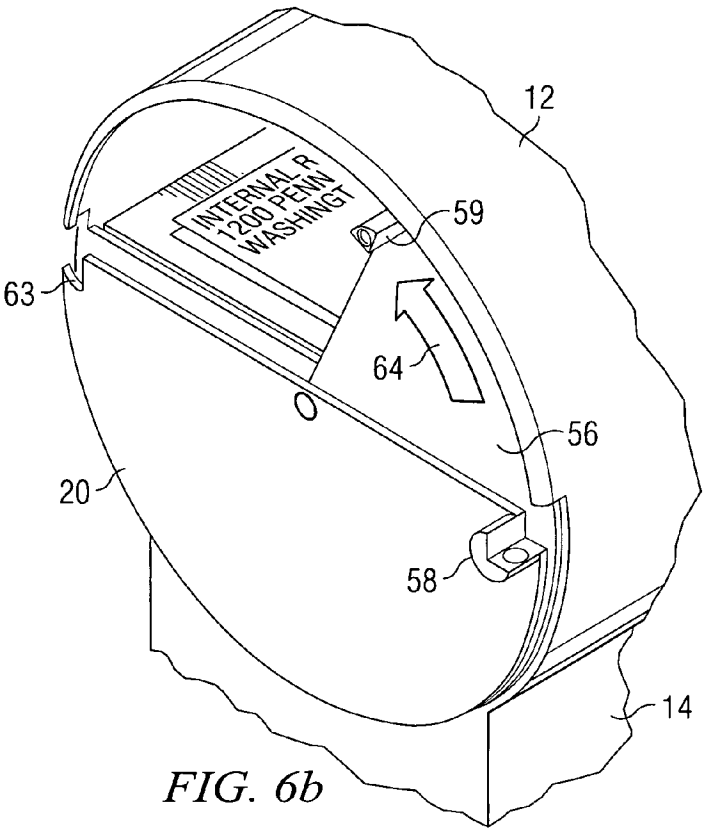
Figure 6C:
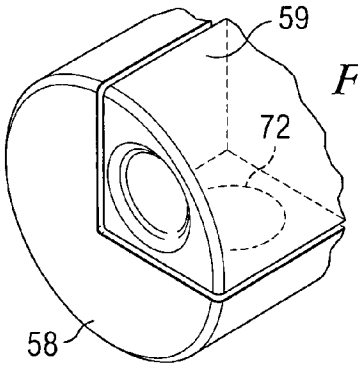
Figure 6A:
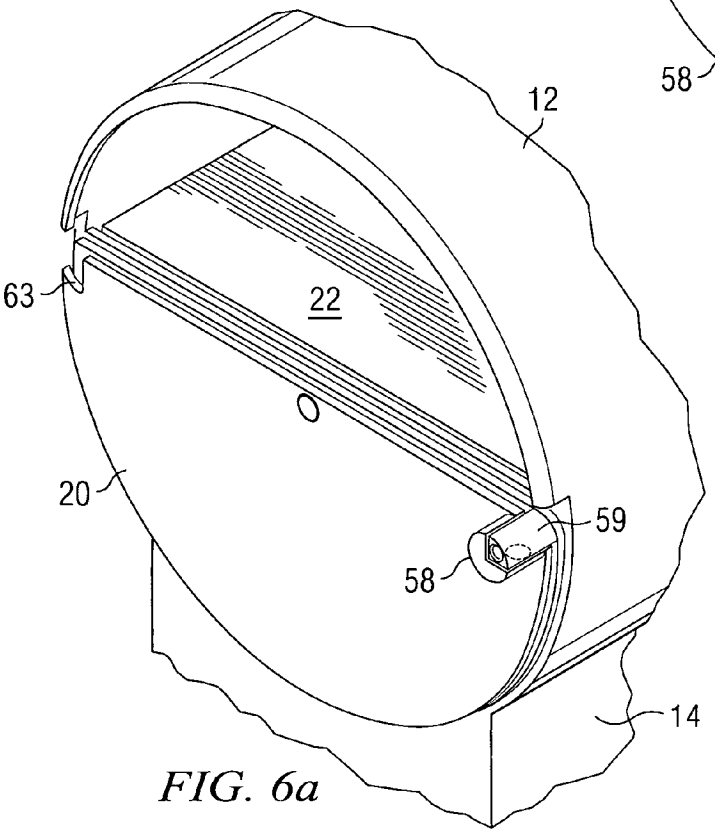
Figure 9:
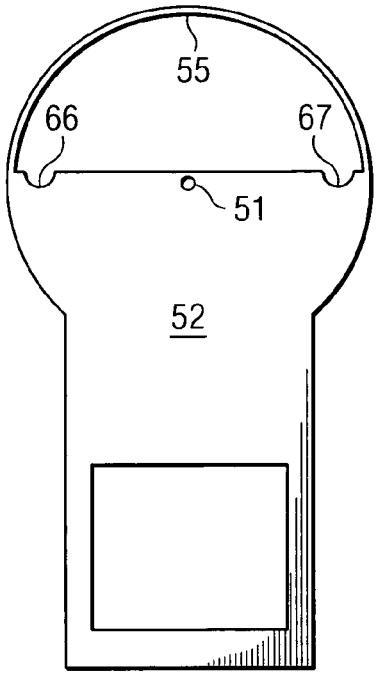
Figure 10:
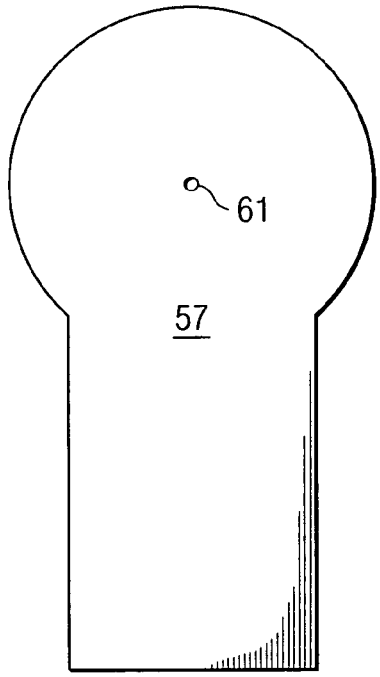
Figure 11A:
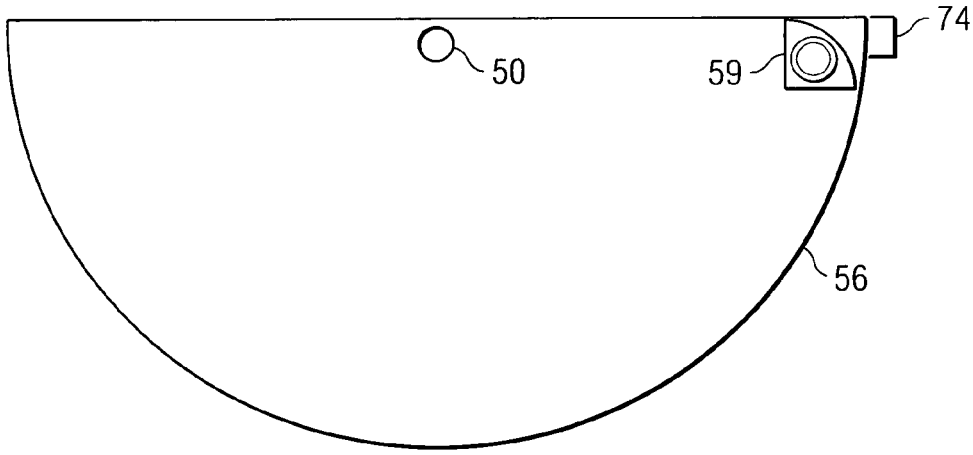
Figure 11B:
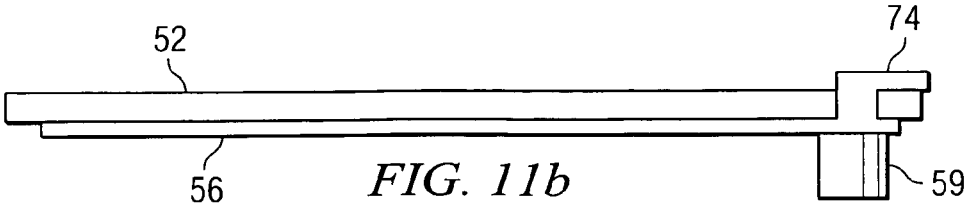

FIGS. 5*a*-5*c* illustrate the steps in installing the mail box along a curb;

FIG. 6*a* is an isometric view illustrating the mail box with the flag door and the main door in respective open positions;

FIG. 6*b* is an isometric view of the mail box illustrating the movement of the flag door to the closed position after mail has been deposited on the rotatable platform;

FIG. 6*c* is an enlarged isometric view of the nesting of the flag door knob in the main door knob;

FIGS. 7*a*-7*d* are frontal views of the mail box according to the invention, with the doors rotatable in order to deposit outgoing mail on the rotatable platform;

FIGS. 8*a*-8*d* are frontal views of the mail box according to the invention, with the doors rotated in order to receive incoming mail and drop the mail into the underlying secure compartment;

FIGS. 9 and 10 are respective frontal and back views of the mail box according to the invention; and FIG. 11*a* is a frontal view of the flag door equipped with the knob and a guide, and FIG. 11*b* is a top view of the flag door guide.

DETAILED DESCRIPTION OF THE INVENTION

Figure 1:
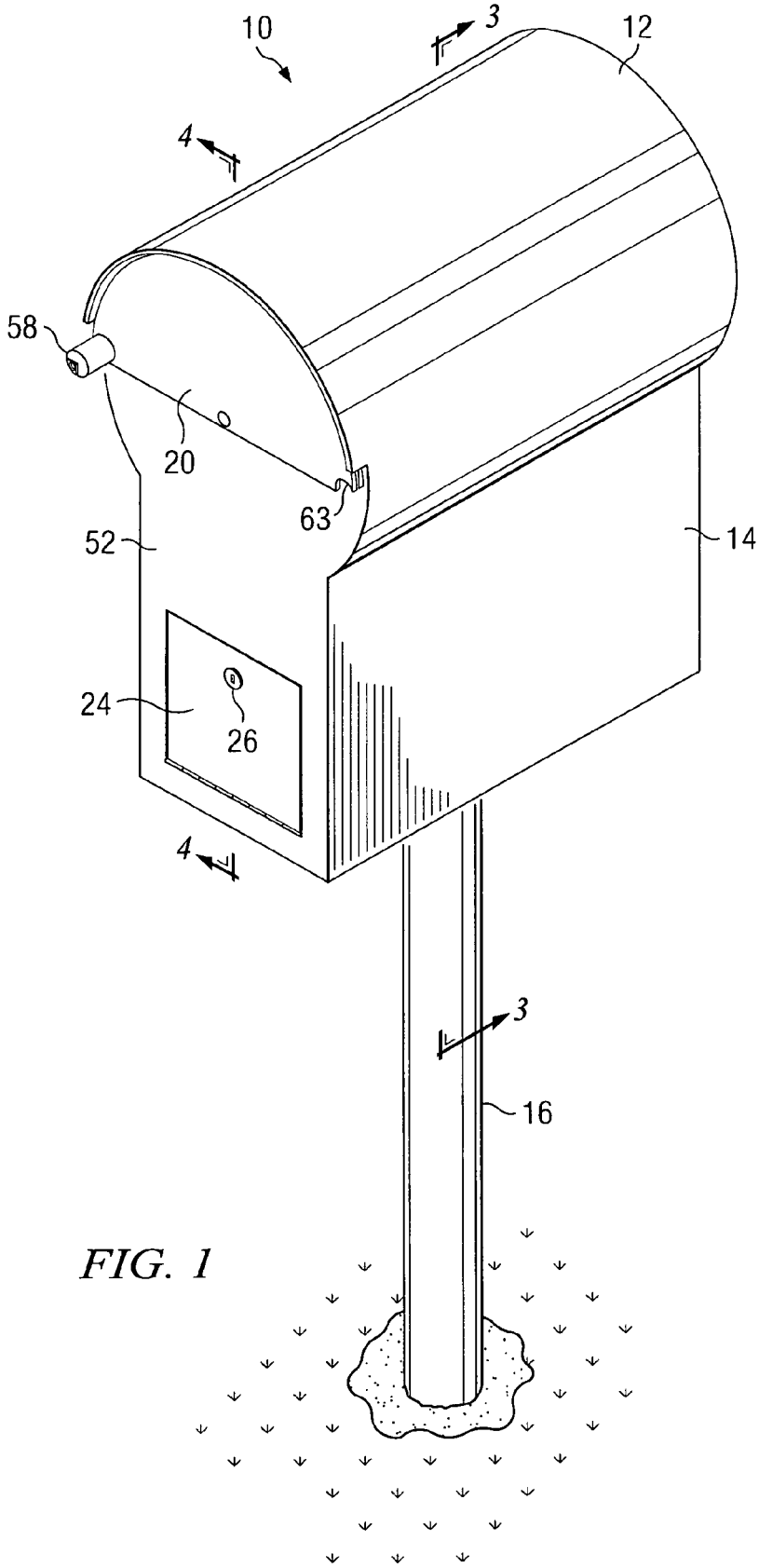
FIG. 1 is an isometric view of a mail box constructed according to the invention.
Figure 2:
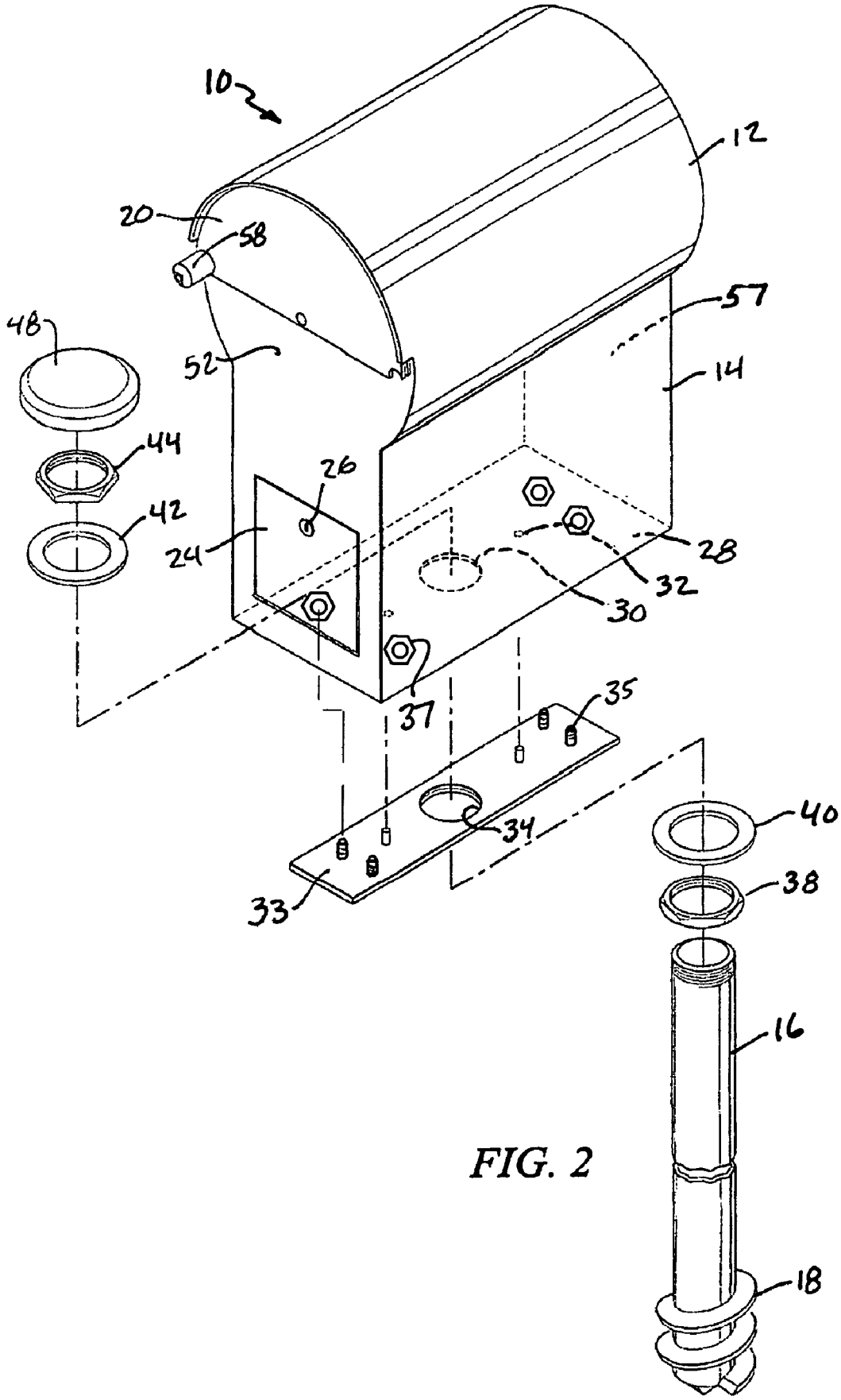
FIG. 2 is an exploded view of the mail box of the invention, illustrating the manner in which the mailbox is attached to a post anchored in the ground.

With reference to FIG. 1, there is shown a mailbox 10 constructed according to the preferred embodiment of the invention. The mailbox 10 includes a depository vault 12 attached to a secure incoming compartment 14. The depository vault 12 and the secure incoming compartment 14 are preferably constructed of sheet metal, either in one piece formed in the shape shown, or as two separate units that are bolted or welded together. The bottom of the secure incoming compartment 14 is fastened to a stand 16 that is anchored in the ground by an auger 18, as shown in FIG. 2. The stand 16 can also be used without an auger 18, and anchored in the ground in a conventional manner. The depository vault 12 includes a rotatable main door 20 to close or open a semicircular opening formed in the front of the depository vault 12. The main door 20 is rotatable clockwise about a central horizontal axis to an open position for either depositing outgoing mail in the depository vault 12, or for depositing incoming mail therein by a postman. As will be described in more detail below, the incoming mail deposited by a postman is initially placed on a platform 22 (FIG. 3) that rotates with the main door 20, and when the main door 20 is rotated CCW to a closed position, the mail drops downwardly into the secure incoming compartment 14. When the mail drops in the secure incoming compartment 14, it cannot otherwise be retrieved or obtained, except by access via a locked compartment door 24. The lockable compartment door 24 can be opened by use of a conventional key and lock 26 so that the user of the mailbox can retrieve the incoming mail from the secure incoming compartment 14.

With reference to FIG. 2, there is shown an exploded view of the major components of the mailbox 10 according to the invention. The depository vault 12 is barrel-shaped with a closed back, and with a semicircular top opening in the front, shown covered by the rotatable main door 20. The bottom semicircular portion of the front of the depository vault 12 is covered with sheet metal. The secure incoming compartment 14 is generally box-shaped and formed or otherwise fastened to the bottom of the depository vault 12. The secure incoming compartment 14 is constructed with four sides and a bottom 28, but no top. The bottom 28 of the secure incoming compartment 14 has a central hole 30 formed therein. Two other registration holes, one shown as numeral 32, are also formed in the bottom 28 of the secure incoming compartment 14.

The mailbox 10 is attached to a stand 16. The stand 16 includes a pipe that is threaded on the top end and has an auger 18 fastened to the bottom end. A base plate 33 formed of a heavy duty metal can be fastened to the top of the stand 16 by first threading a large nut 38 onto the threads of the stand 16, and then placing a large washer 40 on top of the nut 38. The base plate 33 is then placed on the stand by aligning the threaded hole 34 of the base plate 33 with the stand 16 and threading it onto the pipe 16 on top of the washer 40. Temporarily, the base plate 33 can be fastened to the stand 16 by placing a top washer 42 on the base plate 33 and fastening it to the stand 16 with a top nut 44. The base plate 33 is essentially sandwiched between the bottom nut 38 and the top nut 44.

As an alternative to the foregoing manner of attaching the mailbox 10 to the stand 16, the base plate 33 can be welded or otherwise made integral with the stand 16. With this arrangement, the base plate 33 would have threaded studs, one shown as numeral 35, fastened thereto and protruding upwardly. The bottom 28 of the secure incoming compartment 14 would have four holes therein to receive the respective threaded studs 35. The mail box 10 would be fastened to the base plate 33 by screwing nuts 37 onto the threaded studs 35. Access to the threaded studs 35 would be through the secure incoming compartment 14.

The installation of the stand 16 into the ground is shown in FIGS. 5*a*-5*c*. The base plate 33 initially functions as a handle to the auger 18 fastened to the bottom of the stand 16. The user simply rests the bottom point of the auger 18 on the ground where it is desired to install the mailbox 10. The base plate 33 is then manually rotated in a clockwise direction to auger the stand 16 into the ground and thus form a hole. During the auger process, the stand 16 is removed to empty the hole of dirt. Once the hole is sufficiently deep, for example eighteen inches deep, both the stand 16 and the auger 18 are placed in the hole. Wet cement or concrete 46 is then poured into the hole around the base of the stand 16 and around the auger 18. The stand 16 can be rotated or jostled to make sure the cement has engulfed both the auger 18 and the bottom portion of the stand 16. The stand 16 is then left until the concrete 46 has set and is cured, as shown in FIG. 5*b*.

When the concrete 46 has set, the base plate 33 is repositioned on the stand 16 so as to be perpendicular to the street or sidewalk, as shown in FIG. 5*c*. The top washer 42 and nut 44 are removed. The mailbox 10 is then lifted and placed on the base plate 33 so that the threaded part of the stand 16 protrudes through the hole 30 in the bottom 28 of the secure incoming compartment 14, in a manner such that the pins 36 attached to the base plate 33 protrude through the registration holes 32 formed in the bottom 28 of the secure incoming compartment 14. The top washer 42 is then placed over the compartment bottom 28 and over the threaded end of the stand 16. The top nut 44 is secured to the top of the stand 16. The top nut 44 is tightened so that the mailbox 10 cannot be turned with respect to the stand 16. For further securement, the hole 30 in the compartment bottom 28 can be formed as a splined opening for fitting onto a splined and threaded top of the stand 16. Lastly, a cotter pin is inserted through a hole in the top of the pipe 16 and above the nut 44. A cap 48 can be placed over the top of the threaded end of the stand 16 to prevent small mail from getting caught and to cover the vertical bore of the hollow stand 16.

Figure 3:
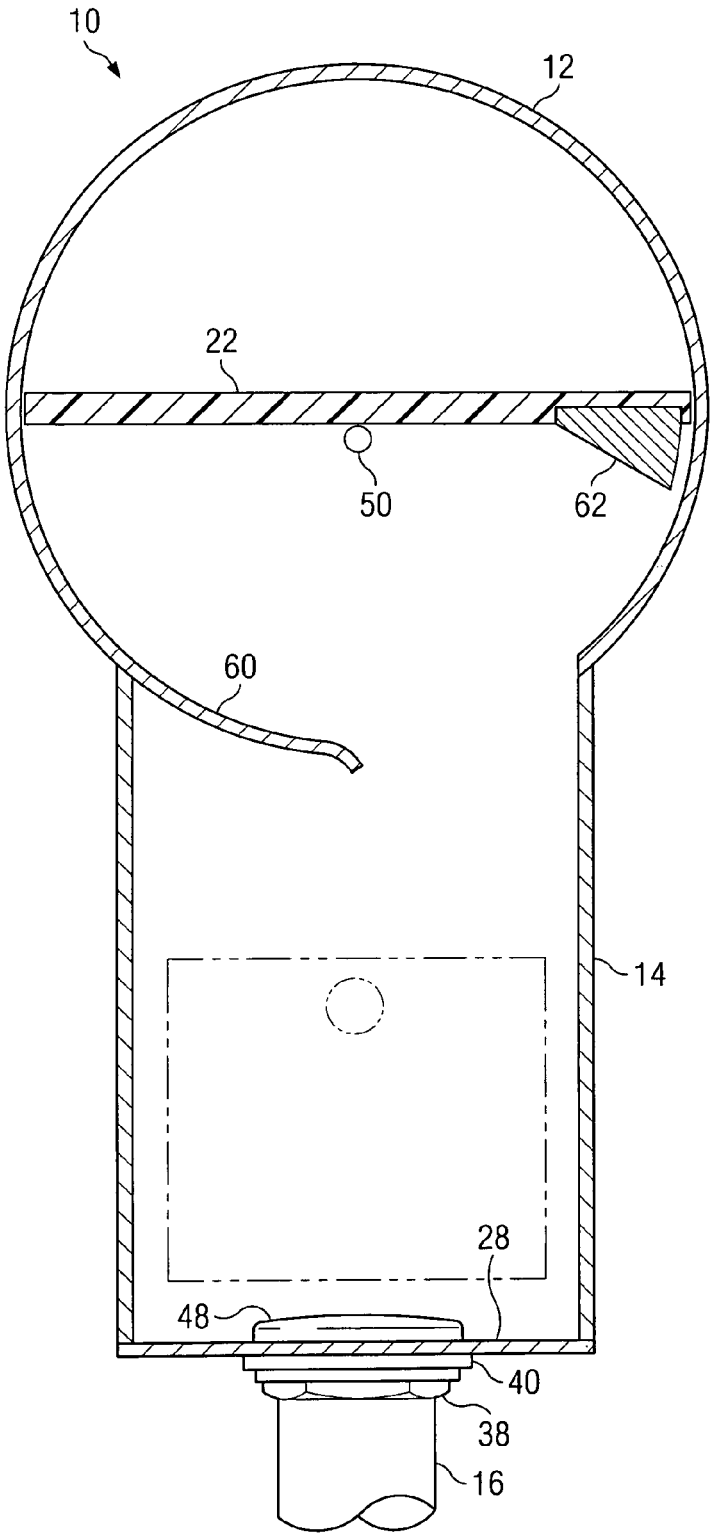
FIG. 3 is a cross-sectional view of the mail box, taken along line 3-3 of FIG. 1.
Figure 4:
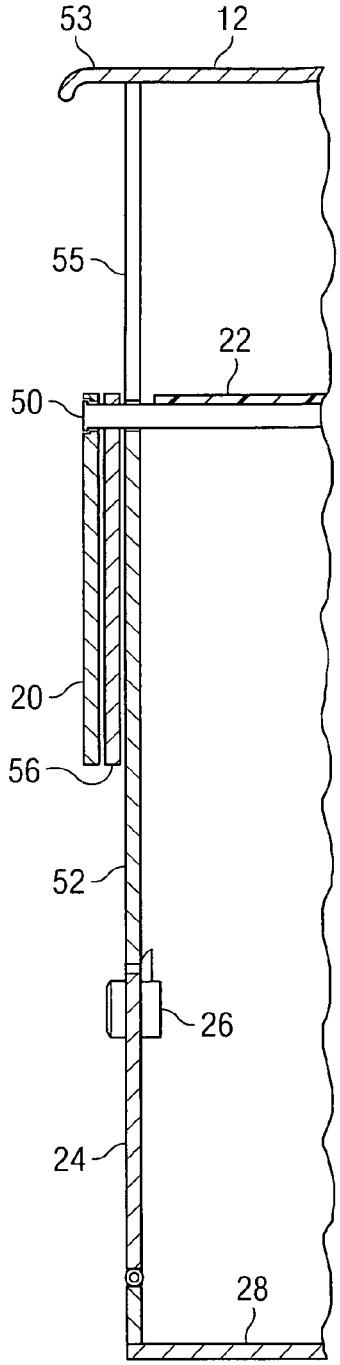
FIG. 4 is a partial cross-sectional view of the mail box, taken along line 4-4 of FIG. 1.

FIG. 3 illustrates a frontal cross-sectional view of the mailbox 10 according to the invention, taken along line 3-3 of FIG. 1, and FIG. 4 illustrates a side cross-sectional view of the mailbox 10, taken along line 4-4 of FIG. 1. FIG. 9 illustrates the construction of the facade 52, and FIG. 10 illustrates the construction of the rear plate 57 of the mailbox 10. As can be seen from FIG. 3, the depository vault 12 is generally cylindrical shaped, with a covered back side and a bottom which opens into the top of the secure incoming compartment 14. As shown in FIG. 9, the front of the mailbox 10 has a planar facade 52 which covers the front of the secure incoming compartment 14, except for the semicircular door opening. The facade 52 also covers the bottom half of the semicircular frontal portion of the depository vault 12. The facade 52 includes a left notch 66 and a right stop 67 in which the main door knob 58 and flag door knob 59 are cradled when rotated to the extreme positions. The facade 52 further includes a hole 51 through which a platform shaft 50 extends. Lastly, the facade 52 is constructed with a bail 55 to which the barrel portion of the depository vault 12 is fastened by tack welding, screws, rivets, or other fastening means.

Rotatably mounted within the depository vault 12 is the platform 22 on which mail rests. The platform 22 is illustrated in FIG. 3, and is shown fastened to the shaft 50 that also extends from the front to the back of the depository vault 12. The shaft 50 is mounted for rotation to the rear plate 57 (FIG. 10), as well as to the facade 52 (FIG. 9) of the mailbox 10. A bore 61 formed partially through the rear plate 57 forms a support for the end of the platform shaft 50. The front of the shaft 50 can be inserted in a hole 51 formed in the facade 52 during assembly of the mailbox 10. The semicircular-shaped main door 20 is fastened to the front end of the shaft 50. In addition, a red-colored flag door 56 has a hole therein for rotation about the platform shaft 50. Thus, when the main door 20 is rotated by use of a knob 58 (FIGS. 6*a* and 6*b*) the platform 22 rotates in a corresponding direction. The red flag door 56 can be rotated independent of the main door 20 and independent of the platform 22. The function of the flag door 56 is to provide an indication to the mailman that mail is available for pick up on the platform 22 of the rotatable vault 12 and delivery to a main post office.

Fixed to the right side of the platform 22 (FIG. 3) is a counterweight 62 to assure that the platform 22 returns to the horizontal position when the main door 20 is less than half way open, i.e. when the counterweight 62 of the platform 22 is generally between the twelve o'clock and three o'clock positions. When the platform 22 is horizontal, as shown in FIG. 3, the semicircular-shaped main door 20 does not cover the frontal semicircular opening in the top portion of the depository vault 12. When the platform 22 and main door 20 are rotated 180 degrees counterclockwise from that shown in FIG. 3, the semicircular-shaped main door 20 completely covers the top semicircular opening to the depository vault 12.

According to an important feature of the invention, a security guard 60 extends over a portion of the open top of the security incoming compartment 14, as shown in FIG. 3. The security guard 60 extends from the front to the back of the mailbox 10, as a partial divider between the depository vault 12 and the secure incoming compartment 14. In addition, the security guard 60 is curved and extends laterally about half way across the top portion of the security incoming compartment 14. This is important in order to prevent an unauthorized person from opening the main door 20 of the mailbox 10 and rotating it, together with the platform 22, and reaching down into the security incoming compartment 14 and gaining access to the mail deposited therein by the postman. This feature is better understood by reference to FIG. 6*a* where the status of the main door 20 is shown in the open position. The operation of the flag door 56 is shown in FIG. 6*b*.

The main door 20 has a knob 58 attached thereto, and the flag door 56 has a knob 59 attached to it. The structural details of the knobs 58 and 59 are shown enlarged in FIG. 6*c*. The main door knob 58 is generally a solid cylinder with a cupped or cutout portion. The flag door knob 59 is shaped to fit within the cutout portion of the main knob 58. The relationship between the main door knob 58 and the flag door knob 59 is such that when the main door 20 is rotated CCW using the main door knob 58, the flag door 59 is carried with the main door 20 due to engagement of the flag door knob 59 within the cutout of the main door knob 58. When the main door 20 is positioned in the fully CCW or closed position, the flag door is also forced to the closed position. However, when main door 20 is open as shown in FIGS. 6*a* and 6*b*, the cutout in the main door knob 58 is oriented so as to allow the flag door knob 59 to be moved out of engagement with the main door knob 59. This allows the flag door 56 to be moved CCW to the closed position while the main door 20 remains in the fully open position.

Figure 7A:
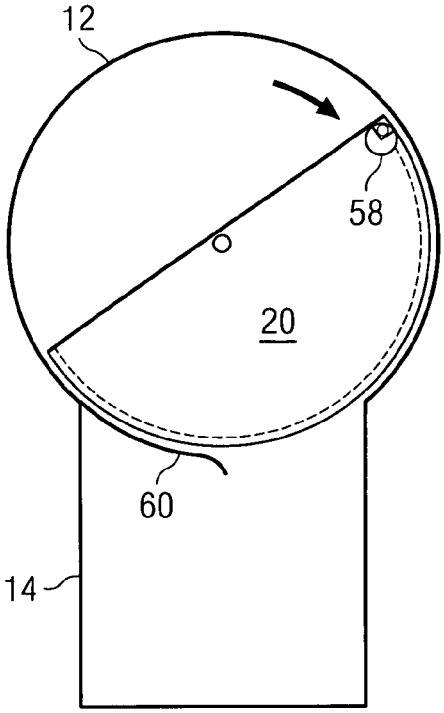
Figure 7B:
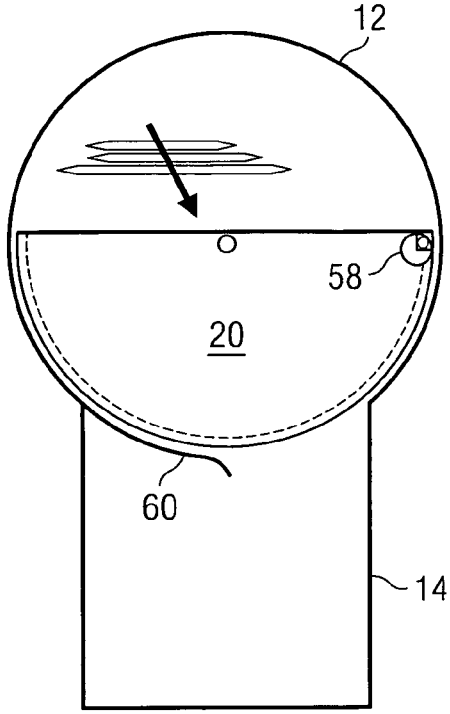
Figure 7C:
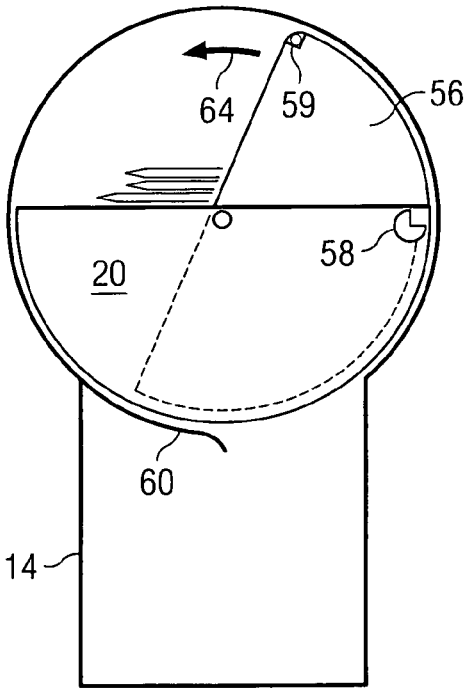
Figure 7D:
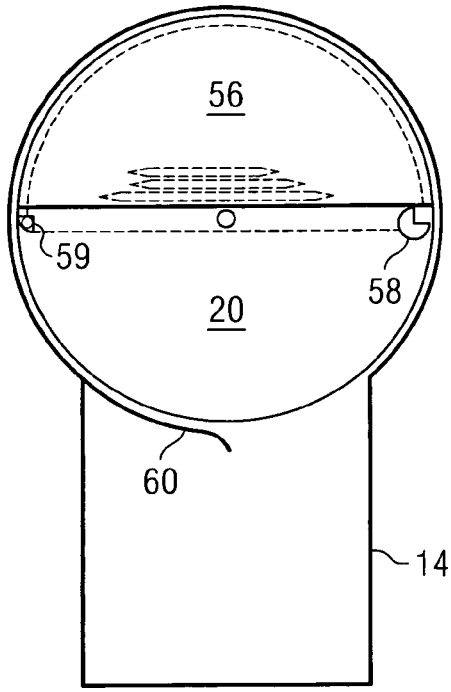

When the main door 20 is open, there is access to the platform 22 via the upper semicircular opening in the depository vault 12, as shown in FIG. 6*a*. As shown in FIG. 7*a*, both the main door 20 and the flag door 56 can be rotated CW to provide access to the platform 22. When the flag door 56 is rotated fully CCW, the knob 59 rests in a cutout 63 of the main door 20. When it is desirable to place outgoing mail in the mailbox 10 for pickup by the mailman, one need only place the mail on the horizontally-positioned platform 22 (FIG. 7*b*), and then move the flag door knob 59 counterclockwise (FIG. 7*c*). The direction of rotation of the flag door 56 is shown by arrow 64 in FIGS. 6*b* and 7*c*. This action is effective to close the top semicircular opening to the depository vault 12 (FIG. 7*d*). Preferably, the flag door 56 is colored red to indicate to the postman that mail is to be picked up from the mailbox 10. Since the flag door 56 rotates independently on the shaft 50, the flag door 56 can be moved without also rotating the platform 22. A magnet 72 can be fastened to the main door knob 58 to magnetically hold the flag door knob 59 to the main door knob 58. The magnet 72 is shown in phantom in FIG. 6*c*. When the mailman sees that the red flag door 56 is exposed, he/she can simply rotate the flag door 56 clockwise to gain access to the outgoing mail resting on the platform 22. As noted in FIG. 6*b*, the main door 20 has a notch 63 formed therein for receiving the knob 59 of the flag door 56 when the latter is rotated fully counterclockwise to the closed position.

FIG. 11*a* illustrates the flag door 56 constructed with a guide 74. FIG. 11*b* is a top view of the flag door 56 and associated guide 74. The guide 74 is fastened to the flag door 56 and protrudes backwardly so as to engage with the horizontal edge of the planar facade 52. The guide 74 functions to prevent the flag door 56 from rotating more than 180 degrees when the main door 20 is in the closed position. In this situation, the guide 74 on the flag door 56 will catch on the horizontal edge of the planar facade 52 and stop further rotation of such door 56. When the main door 20 is rotated to the open position, the flag door 56 is prevented from rotating more than 180 degrees by engagement of the flag door knob 59 with the notch 63 in the main door 20.

The receiving of incoming mail to the mailbox 10 is shown in FIGS. 8*a*-8*d*. Preferably, the main door 20 has been previously rotated counterclockwise to its closed position in FIG. 8*a*. This position of the main door 20 closes the semicircular opening to the depository vault 12 to keep rain, snow and the like out of the mailbox 10. As another protection against the weather, a rain guard 53 is provided over the front, top portion of the mailbox 10. The rain guard 53 is curled to prevent rain, snow and the like from entering into the closed or open mailbox 10. Any rain, snow or the like which may accumulate on the rain guard 53 will drip or fall off instead of falling into the semicircular opening of the mailbox 10. The details of the rain guard 53 are shown in FIG. 4.

Figure 8A:
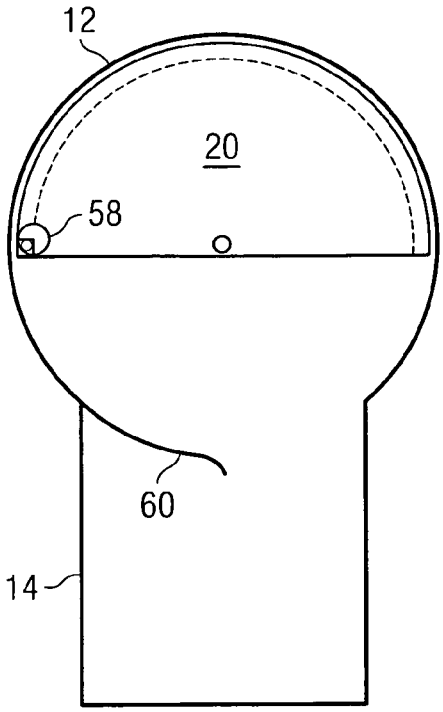
Figure 8B:
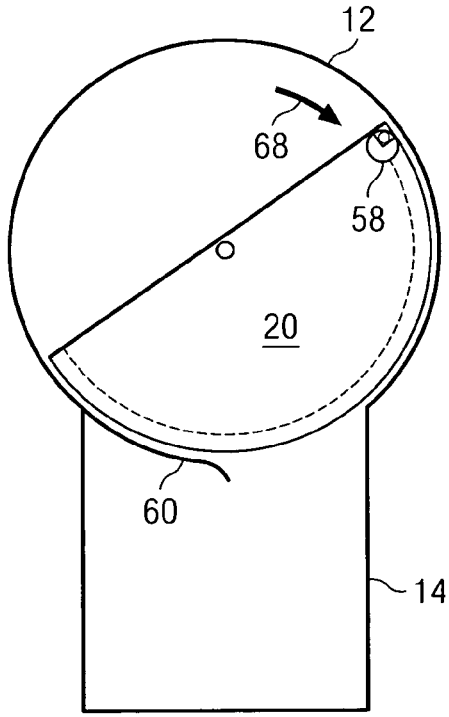
Figure 8C:
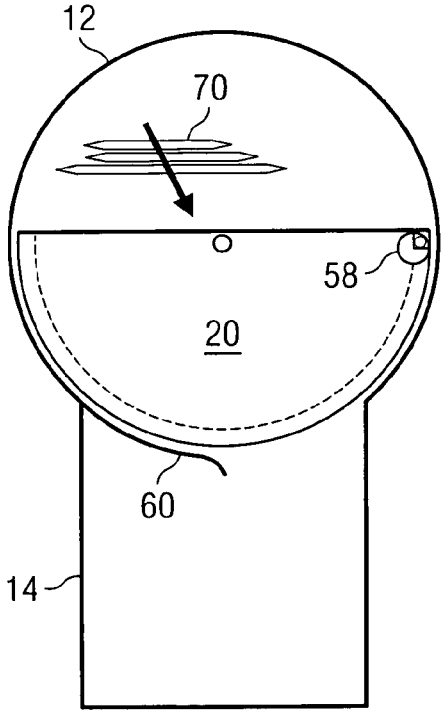
Figure 8D:
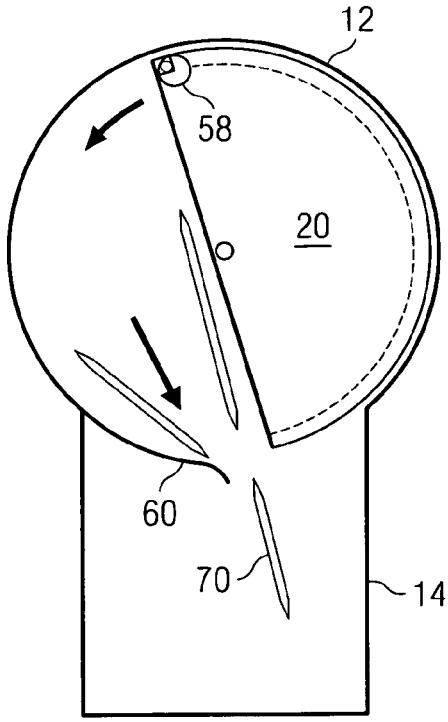

Returning to FIGS. 8*a*-8*d*, when the postman has incoming mail to be delivered to the mailbox 10, the postman simply rotates the main door 20 clockwise using the knob 58, as shown by arrow 68 in FIG. 8*b*, to provide access to the depository vault 12, and more particularly the platform 22. The incoming mail 70 is deposited by the postman on the platform 22 inside the depository vault 12. This is shown in FIG. 8*c*. Next, the postman grasps the main door knob 58 and rotates it counterclockwise to thereby rotate the platform 22 and the main door 20 in a corresponding direction. As a result, the platform 22 rotates as shown in FIG. 8*d*, whereupon the incoming mail 70 drops into the secure incoming compartment 14 which underlies the depository vault 12. In the fully counterclockwise position, the main door 20 closes the semicircular opening in the depository vault 12.

It is important to understand that when the main door 20 and platform 22 have been rotated to the CCW position shown in FIG. 8*d* to deposit the incoming mail in the secure incoming compartment 14, there is limited access from outside the mailbox 10 through the depository vault 12 to the secure incoming compartment 14. This limited access is achieved because in this position, the main door 20 substantially closes the semicircular opening to the depository vault 12, and there is very little space between the edge of the security guard 60 and the platform 22. These two restrictions to the security incoming compartment 14 prevent a person from reaching in from the outside of the mailbox 10 with his/her arm, or an object, and attempting to retrieve the mail previously deposited in the secure incoming compartment 14. In any event, once the mailman has rotated the main door 20, and thus the platform 22 to the fully counterclockwise position to deposit the incoming mail in the secure incoming compartment 14, the main door 20 is left in the closed position, again to prevent rain from entering into the internal portions of the mailbox 10. The counterweight 62 assists in closing the main door 20' and keeping such door 20 closed, when in the 11:00 o'clock and 9:00 o'clock positions.

In order to retrieve the incoming mail, an authorized person inserts a key in the lock 26 to unlock the compartment door 24 so as to have access to the mail deposited in the secure incoming compartment 14 by the postman. Once the mail is retrieved, the compartment is again locked so as to provide a secure compartment 14. The compartment door 24 and lock 26 can be located in the front of the secure compartment 14, as shown, or alternatively in the back or in either side of the secure compartment 14.

From the foregoing, disclosed is a mailbox having a secure incoming compartment to receive mail. A main door is made rotatable with a platform on which mail is laid, so that the rotation of the main door also rotates the platform to automatically deposit the mail to the secure compartment as well as close the opening to the depository vault. A flag door is also provided and made rotatable to cover and uncover the opening in the rotatable vault to provide an indication to the postman that outgoing mail is on the platform, as well as close the opening to the depository vault.

A number of the mailboxes described above can be constructed and fastened side-by-side in a row for servicing a number of customers. Multiple mailboxes could be mounted on a single stand, or two spaced-apart stands can be anchored in the ground with a beam spanning the stands. A number of mailboxes could then be mounted to the beam.

While the preferred and other embodiments of the invention have been disclosed with reference to a specific mailbox, it is to be understood that many changes in detail may be made as a matter of engineering choices without departing from the spirit and scope of the invention, as defined by the appended claims.

What is claimed is:

1. A mail box, comprising:

a depository vault having an opening thereto for depositing and receiving mail in said depository vault;

a secure incoming compartment underlying said depository vault;

a main door rotatable to open and close the opening in said depository vault;

a platform mounted to said main door and rotated in unison with said main door, the platform adapted for receiving incoming mail thereon via the opening in said depository vault, and when the main door is rotated to a closed position, the platform correspondingly rotates so as to drop the incoming mail in said secure incoming compartment; and a flag door rotatable to open and close the opening in said depository vault, and wherein said flag door is rotatable without rotating said platform.

2. The mail box of claim 1, wherein said main door and said flag door are rotatable from respective closed positions to respective open positions without extending beyond said mail box.

3. The mail box of claim 1, wherein said main door is attached to said platform so as to be generally orthogonal to said platform.

4. The mail box of claim 3, wherein said platform rotates about an axis, and said main door is orthogonal to said axis.

5. The mail box of claim 1, wherein said main door is generally semicircular in shape to cover said opening in said depository vault which is also semicircular shaped.

6. The mail box of claim 5, wherein said flag door is semicircular shaped.

7. The mail box of claim 1, wherein said main door is fastened to said platform by a rod.

8. The mail box of claim 7, wherein said flag door has a hole therein through which said rod extends, and said flag door is freely rotatable around said rod.

9. The mail box of claim 1, wherein said depository vault is barrel-shaped, with a front and a back, said back of said barrel-shaped depository vault being closed, and said front of said barrel-shaped depository vault having a bottom semicircular half closed, and a top semicircular open half defining said opening in said depository vault.

10. The mail box of claim 1, further including a main door knob and a flag door knob, said knobs adapted for grasping and rotating said main door and said flag door respectively, said main door knob adapted for engaging said flag door knob so that when said main door knob is moved to rotate said main door to a closed position, said flag door knob is carried with said main door knob to thereby move said flag door to the closed position.

11. The mail box of claim 10, wherein said flag door knob is engaged with said main door knob so that when said flag door is moved to a closed position, said main door can remain open.

12. A mail box, comprising:

a barrel-shaped depository vault having opposing ends, one end of said barrel-shaped depository vault closed with a planar side, and an opposite end of said barrel-shaped depository vault having a semicircular-shaped opening therein for depositing and receiving mail in said depository vault;

a secure incoming compartment underlying the depository vault;

a semicircular-shaped main door rotatable to open and close the semicircular-shaped opening in said depository vault;

a platform mounted to said main door and rotated in unison with said main door, the platform adapted for receiving incoming mail thereon via the opening in said depository vault, and when the main door is rotated to a closed position the platform correspondingly rotates so as to drop the incoming mail in said secure incoming compartment; and a flag door rotatable to open and close the semicircular-shaped opening in said depository vault, said flag door rotatable to close the semicircular-shaped opening in said depository vault while said main door remains in an open position, and wherein said flag door is movable independently of said platform.

13. The mail box of claim 12, wherein said flag door is semicircular-shaped.

14. The mail box of claim 13, wherein an outside surface of said flag door is painted red to indicate outgoing mail in said mail box.

15. The mail box of claim 14, wherein when said main door and said flag door are both rotated to a closed position to close the opening in said depository vault, said main door covers said flag door, and when said main door is rotated to an open position while said flag door is in the closed position, the red color on said flag door is visible.

16. The mail box of claim 13, wherein said main door and said flag door rotate about the same axis.

17. The mail box of claim 13, further including a knob fastened to said main door and a knob fastened to said flag door, and further including a magnet for magnetically attaching said main door knob to said flag door knob.

18. A method of using a mail box, comprising the steps of:

rotating a main door of said mail box to an open position to expose an opening in said mail box, thereby allowing mail to be deposited in a depository vault of said mail box;

depositing outgoing mail onto a platform located in said depository vault and rotating a flag door to a closed position to close the opening in said mail box, and leaving the main door in the open position;

moving the flag door to the open position to retrieve the outgoing mail deposited on the platform; and depositing incoming mail on the platform and rotating the main door to a closed position, where rotation of the main door causes rotation of the platform to thereby drop the incoming mail in a secure compartment located below said depository vault.

* * * * *